US010066865B2

(12) United States Patent
Fotiadis et al.

(10) Patent No.: US 10,066,865 B2
(45) Date of Patent: Sep. 4, 2018

(54) REFRIGERATOR AND METHOD FOR THE TEMPERATURE CONTROL IN A REFRIGERATOR

(75) Inventors: Panagiotis Fotiadis, Giengen (DE); Jochen Härlen, Königsbronn (DE); Harald Joksch, Vöhringen (DE)

(73) Assignee: BSH Hausgeräte GmbH, München (DE)

( * ) Notice: Subject to any disclaimer, the term of this patent is extended or adjusted under 35 U.S.C. 154(b) by 732 days.

(21) Appl. No.: 13/132,610

(22) PCT Filed: Nov. 24, 2009

(86) PCT No.: PCT/EP2009/065745
§ 371 (c)(1),
(2), (4) Date: Jun. 3, 2011

(87) PCT Pub. No.: WO2010/078997
PCT Pub. Date: Jul. 15, 2010

(65) Prior Publication Data

US 2011/0225994 A1 Sep. 22, 2011

(30) Foreign Application Priority Data

Dec. 18, 2008 (DE) ..... 10 2008 054 934

(51) Int. Cl.
*F25D 21/06* (2006.01)
*F25D 17/06* (2006.01)
(Continued)

(52) U.S. Cl.
CPC ..... *F25D 17/062* (2013.01); *F25D 21/04* (2013.01); *F25D 29/00* (2013.01); *F25D 17/045* (2013.01);
(Continued)

(58) Field of Classification Search
CPC ..... F25D 17/062; F25D 29/00; F25D 21/04; F25D 2700/122; F25D 2600/02;
(Continued)

(56) References Cited

U.S. PATENT DOCUMENTS 3,138,006 A * 6/1964 Moorman et al. ..... 62/156
4,569,205 A * 2/1986 Dempou et al. ..... 62/155
(Continued)

FOREIGN PATENT DOCUMENTS

CN 1174319 A 2/1998
CN 1448680 A 10/2003
(Continued)

OTHER PUBLICATIONS

Cappelletti (EP0897142) NPL—English Version.*
(Continued)

*Primary Examiner* — Larry Furdge
(74) *Attorney, Agent, or Firm* — Nixon & Vanderhye, P.C.

(57) ABSTRACT

A refrigerator, in particular a household refrigerator, includes an utility chamber for cooled goods and a control device, with which a cold air flow can be introduced into the utility chamber when a cooling signal is present. A defrost heating element is rendered operative by the control device to prevent the formation of condensate and/or ice due to the cold air flow fed into the utility chamber. A timing element keeps the heating element out of operation for a predetermined time interval in response to the generation of the cooling signal.

20 Claims, 3 Drawing Sheets

(51) Int. Cl.
*F25D 21/04* (2006.01)
*F25D 29/00* (2006.01)
*F25D 17/04* (2006.01)

(52) U.S. Cl.
CPC ..... *F25D 2400/02* (2013.01); *F25D 2600/02* (2013.01); *F25D 2700/02* (2013.01); *F25D 2700/12* (2013.01); *F25D 2700/122* (2013.01); *F25D 2700/14* (2013.01)

(58) Field of Classification Search
CPC ..... F25D 2700/12; F25D 2700/14; F25D 2400/02; F25D 17/045; F25D 2700/02
USPC ..... 62/80, 151, 155, 234, 275
See application file for complete search history.

(56) References Cited

U.S. PATENT DOCUMENTS 4,852,361 A * 8/1989 Oike ..... 62/131
4,903,500 A * 2/1990 Hanson ..... 62/156
5,542,258 A 8/1996 Shim
5,809,790 A 9/1998 Kwon
5,816,054 A 10/1998 Yoo et al.
5,979,174 A 11/1999 Kim et al.
6,058,724 A * 5/2000 Park ..... 62/156
6,125,641 A 10/2000 Kim et al.
6,415,616 B1 7/2002 Kim
6,427,772 B1 * 8/2002 Oden et al. ..... 165/232
6,655,158 B1 * 12/2003 Wiseman et al. ..... 62/73
7,320,226 B2 1/2008 Strauss
2009/0165476 A1 7/2009 Hosaka

FOREIGN PATENT DOCUMENTS

EP 0897142 A1 * 7/1999 ..... G05D 23/19
EP 0 987 507 A2 3/2000
EP 1878986 A1 1/2008
JP 2001174119 A 6/2001
RU 2130570 C1 5/1999
RU 2313742 C2 12/2007
RU 2337282 C2 1/2008
WO WO 2005/059454 A1 6/2005

OTHER PUBLICATIONS

Report of Examination Including National Search Report CN 200980151510.6.
International Search Report PCT/EP2009/065745.
Decision on Granting issued in corresponding Russian Patent Application No. 2011124740/13 (036575) dated Oct. 1, 2013 (English-language translation only).
Chinese Office Action dated Feb. 14, 2014 in corresponding Chinese Application No. 2009801515106 (English translation only).

* cited by examiner

REFRIGERATOR AND METHOD FOR THE TEMPERATURE CONTROL IN A REFRIGERATOR

BACKGROUND OF THE INVENTION

The invention relates to a refrigerator and a method for controlling a temperature in a utility chamber of a refrigerator.

In so-called no-frost appliances a cold air flow is fed to the utility chamber. The feeding in of cold air results in condensing surfaces with reduced surface temperatures in the utility chamber, on which condensate and/or ice may form. To prevent such condensate and/or ice formation, defrost heating elements may be provided in the utility chamber.

A generic refrigerator is known from EP 1 878 986 A1, in which the cold air flow can be introduced into the utility chamber by means of a control device when a cooling signal is present. The defrost heating element for preventing the formation of condensate and/or ice caused by the cold air flow is switched on or off by means of the control device. The defrost heating element is elaborately controlled by means of signals in accordance with the utility chamber temperature. As soon as the temperature in the utility chamber exceeds an upper temperature threshold, the heating element is switched on. When the temperature falls below a lower threshold, the heating element is switched off.

A further refrigerator with a defrost heating element is known from WO 2008/004441 A1. A compressor is switched on at the start of a cooling operation. When the compressor is switched on, the heating element operation is simultaneously interrupted and resumed following expiry of a time interval. Power consumption by the heating element is interrupted during a start-up phase of the compressor, whereby a stable compressor operation can be established following a brief start-up phase.

A further refrigerator with a defrost heating element is known from JP 2001174119A. The utility chamber in the refrigerator is force-ventilated with cold air. When a target cooled temperature is reached in the cooling chamber, the defrost heating element is switched off for the forced ventilation. As soon as the utility chamber temperature falls below the target temperature, the heating element is switched off with a time delay.

BRIEF SUMMARY OF THE INVENTION

The object of the invention consists in providing a cooling device and a method for temperature control in a refrigerator, with which the energy consumption of the refrigerator can be reduced.

According to the characterizing clause of claim 1, a timing element, with which the heating element remains out of operation for a predefined time interval after generation of the cooling signal, is associated with the heating element. The timing element thus delays the forwarding of the cooling signal to the heating element for the predetermined time interval. In this way, a delayed activation of the heating element after generation of the cooling signal can be achieved easily by means of both signals and controls.

The invention uses the fact that condensate and/or ice does not begin to form on the surfaces of the utility chamber immediately after generation of a cooling signal or the commencement of the cold air flow associated therewith. Instead, it is only after the cold air has been flowing in for a certain period that cold condensing surfaces form in the utility chamber, on which condensate can precipitate.

According to the invention the heating element is not switched on until after such a cooling interval has expired. The time interval predetermined by means of the timing element corresponds approximately to the aforementioned cooling interval which may be set empirically in a series of tests. Temperature sensors for measuring a surface temperature on condensing surfaces within the utility chamber can thereby be avoided.

After expiry of the time interval predetermined by the timing element, the heating element can be activated provided the cooling signal is still present. If the cooling signal is no longer present after expiry of the time interval, the heating element can remain out of operation. If external ambient temperatures are low, in which case only a reduced cold air supply is required, the following set of circumstances arises: the low ambient temperatures result in a low cooling requirement in the utility chamber. The time intervals in which the control device generates the cooling signal are correspondingly short. The signal interval may therefore end before the time interval predetermined by the timing element expires, so that the heating element remains switched off.

Conversely, the cooling signal duration can be prolonged accordingly if ambient temperatures are high or if the appliance door is frequently opened. In this case, however, the proportional impact of the delayed activation of the heating element would only be very slight. Tests have revealed that the length of the time interval predetermined by the timing element may be between 2 and 6 minutes.

In a design variant the heating element may be subjected to varying power levels depending on the ambient temperatures of the refrigerator, in particular with lower power being supplied at lower ambient temperatures than at higher ambient temperatures. In addition and/or alternately to this, the heating element may also be operated for varying lengths of time depending on the number of door openings per time unit, and in particular may be operated for longer with an increasing number of door openings. In particular, the activation duration of the heating element may also be increased when the ambient temperature for the refrigerator increases.

The cold air flow may be fed to the utility chamber by means of a cold air channel. A valve element may preferably be used for generation of the cold air flow in the cold air channel. The valve element opens the cold air channel when the cooling signal is present and closes it when the cooling signal is not present. In addition, a fan that blows the cold air through the cold air channel may be provided for generation of the cold air flow.

By means of signaling, it is easy to achieve a situation in which the heating element does not have a direct signal connection to the control device, i.e. is not directly controlled by the control device, whereby the power consumption of the control device can be reduced. In these circumstances the aforementioned valve element may have an opening sensor assigned to it, which has an direct signal connection to the heating element. The opening sensor can generate an opening signal when the valve element is opened, on the basis of which the heating element can be switched on. In this case the valve element has a direct signal connection to the control device, i.e. the control device opens and closes the valve element. The control device, however, does not directly control the heating element.

The heating element can preferably be provided in a channel wall of the cold air flow that faces the utility chamber. Air outlets are provided in the channel wall, through which the cold air can flow into the utility chamber compartments. The outside of the channel wall facing the utility chamber is therefore particularly susceptible to the formation of condensate and/or ice.

BRIEF DESCRIPTION OF THE DRAWINGS

Two exemplary embodiments of the invention are described below with the aid of the enclosed figures, wherein.

DETAILED DESCRIPTION OF EXEMPLARY EMBODIMENTS OF THE PRESENT INVENTION

Figure 1:
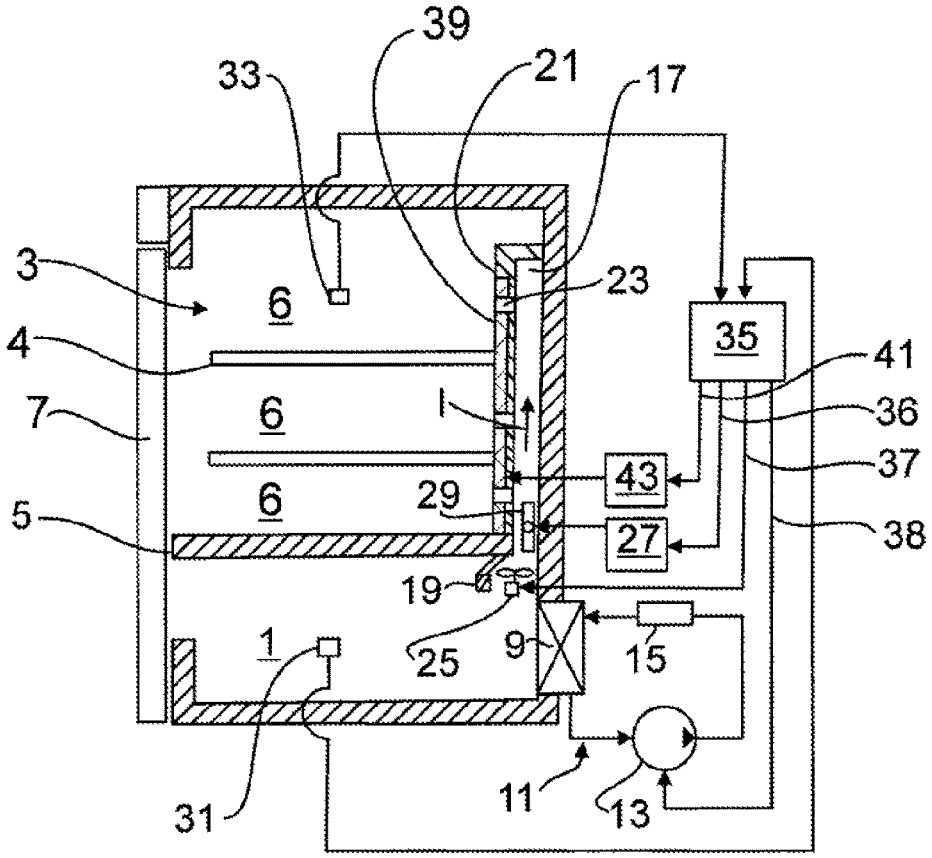
FIG. 1 is a roughly schematic diagram showing a refrigerator of the first exemplary embodiment.

FIG. 1 shows a lateral cross-section view of a refrigerator with a floor-based freezer chamber 1 and an upper cooling chamber 3, which are divided from one another by a horizontal partition 5. The cooling chamber 3 is divided into three refrigerator compartments 6 by means of two horizontal shelves 4. Both the partition 5 and the outer walls of the refrigerator are constructed with heat insulation in a known manner. Both the freezer and the refrigerator chambers 1, 3 are closed at the front by an appliance door 7.

An evaporator 9 is provided in the normal way for cooling the freezer chamber 1, said evaporator here being thermally connected to the rear wall of the freezer chamber 1 by way of example. The evaporator 9 forms part of a refrigerant circuit 11 that is known per se. A compressor 13 and an expansion valve 15 are also connected in the refrigerant circuit shown.

According to FIG. 1, the freezer chamber 1 is fluidically connected to the cooling chamber 3 via a cold air channel 17. The cold air channel 17 is arranged on the rear wall of the refrigerator opposite the appliance door 7 and opens into the freezer chamber 1 with an expanded air inlet 19. The cold air channel 17 extends vertically upwards from the air inlet 19 to directly below the ceiling of the refrigerator that delimits the cooling chamber 3.

The cold air channel 17 is separated from the cooling chamber 3 by means of a cold air channel cover panel 21. Air outlets 23 can be seen in the cover panel 21, though which horizontally directed cold air may flow into the individual refrigerator compartments 6 of the cooling chamber 3.

A fan 25 is arranged in the vicinity of the air inlet 19 of the cold air channel 17. A flap 29 operated electrically by means of an actuator 27 is provided in the flow direction downstream of the fan 25. The flap 29 is shown in FIG. 1 in its open position, into which cold air from the freezer chamber 1 can flow into the cold air channel 17 by means of the fan 25. However, in the closed position (not illustrated) the flap 29 blocks the cold air channel 17, so that cold air cannot flow into the cold air channel 17.

Chamber sensors 31, 33 are provided in each of the freezer and refrigerator chambers 1, 3, which record the respective actual temperatures in the refrigerator and freezer chambers 1, 3 and forward them to a control device 35. If the actual temperature in the freezer chamber 1 that is recorded by the freezer chamber sensor 31 exceeds a target temperature predefined by the user, the control device 35 generates a cooling signal with which the compressor 13 is activated via the signal cable 38. This causes a corresponding cooling capacity to be introduced into the freezer chamber 1 via the evaporator 9. In contrast, the compressor 13 is deactivated by the control device 35 as soon as the actual temperature recorded by the freezer chamber sensor 31 falls below the predefined target temperature.

Figure 2:
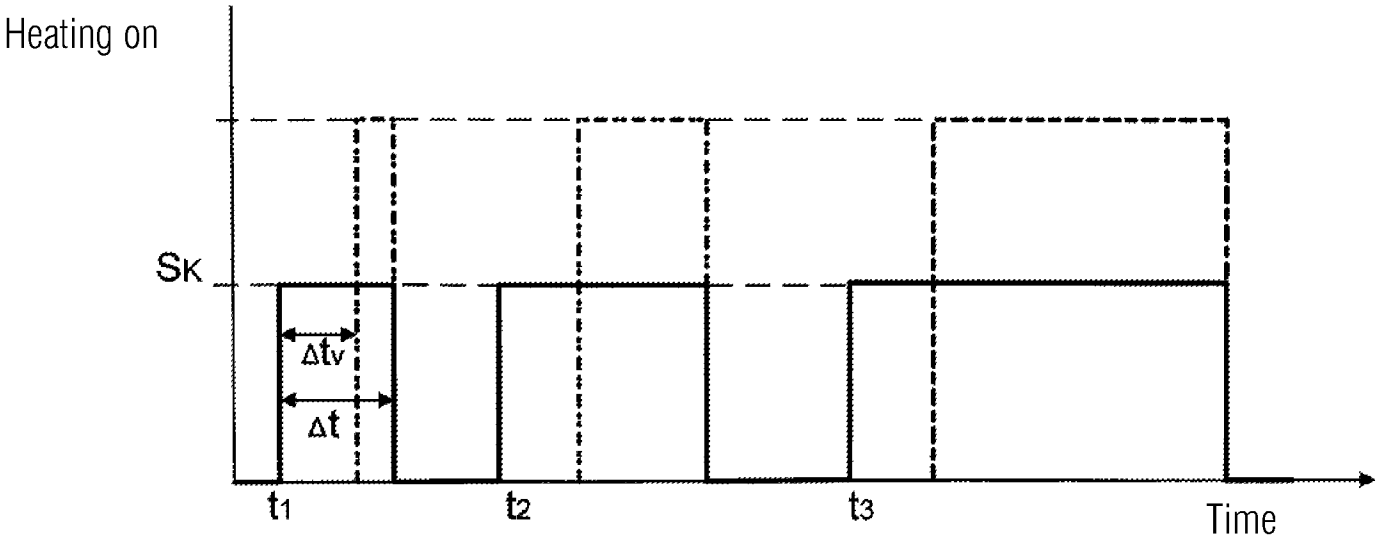
FIG. 2 is a time diagram showing the operating statuses of the defrost heating element during refrigerator operation and overlaid with a time characteristic of a cooling signal $S_K$ generated by a control device.

Similarly to the temperature control in the freezer chamber 1, the actual temperature in the cooling chamber 3 is recorded by the cooling chamber sensor 33 and forwarded to the control device 35. The actual temperature recorded by the cooling chamber sensor 33 is compared to a target temperature. If the target temperature is exceeded the control device 35 generates a cooling signal $S_K$, as illustrated by FIG. 2. The cooling signal $S_K$ is conducted via the signal cables 36, 37, 38 to the actuator 27 of the flap 29, which is adjusted to the open position as shown. The fan 25 and the compressor 13 are accordingly activated via the signal cable 37 and 38 respectively. In this way a cold air flow I is generated, which is conducted from the freezer chamber 1 via the cold air channel 17 into the cooling chamber 3.

According to FIG. 1, a defrost heating element 39 is integrated in the cold air channel cover panel 21, with the aid of which the formation of condensate and/or ice on the side of the cover panel 21 facing the cooling chamber 3 is avoided. As long as a cooling signal $S_K$ is generated in the control device 35 as a result of the target temperature in the cooling chamber 3 being exceeded, the control device 35 controls not only the flap 29, the fan 25 and the compressor 13, but also—via the signal cable 41—the defrost heating element 39 in addition.

However, in contrast to the signal cables 36, 37, 38 leading to the flap actuator 27, the fan 25 and the compressor 13, a timing element 43 is connected in the signal cable 41. This timing element 43 is used to forward the cooling signal $S_K$ to the defrost heating element 39 and therefore to delay activation of the defrost heating element 39. The defrost heating element 39 therefore remains out of operation for a predefined time interval $\Delta t_V$ despite being activated with the cooling signal $S_K$, as shown from the time diagram in FIG. 2.

In the time diagram in FIG. 2 the time characteristic of the cooling signal $S_K$ is shown. The signal characteristic of the cooling signal $S_K$ is overlaid with the running times of the defrost heating element 39. The cooling signal $S_K$, is accordingly generated by the control device 35 from a point in time $t_1$ across a time interval $\Delta t$. When the cooling signal $S_K$ is present the fan 25, the flap 29 and the compressor 13 are activated immediately. In contrast, according to the invention the cooling signal $S_K$, which is delayed via the timing element 43, is forwarded to the defrost heating element 39. The defrost heating element 39 therefore continues to remain out of operation despite the presence of the cooling signal $S_K$ for the time interval $\Delta t_V$ predefined by the timing element 43. Only after expiry of the time interval $\Delta t_V$ is the cooling signal $S_K$ forwarded to the defrost heating element 39, which it then activates.

Similarly, according to FIG. 2, the cooling signal $S_K$ is also generated at each of the points in time $t_2$ and $t_3$. Here, too, the defrost heating element 39 remains out of operation after generation of the cooling signal $S_K$ across the predefined time intervals $\Delta t_V$. The time intervals $\Delta t_V$ are all of equal length and predefined by the timing element 43. The length of the time interval $\Delta t_V$ thus corresponds approximately to one cooling interval, within which the temperature on the outer surface of the cold air channel cover 21 cools down until a condensate can precipitate thereon. Within this cooling interval, therefore, there is not yet any risk that condensate and/or ice will form on the channel cover 21. According to the invention, therefore, it is precisely during this cooling interval that the defrost heating element 39 is out of operation, whereby the energy consumption of the appliance is reduced.

Figure 3:
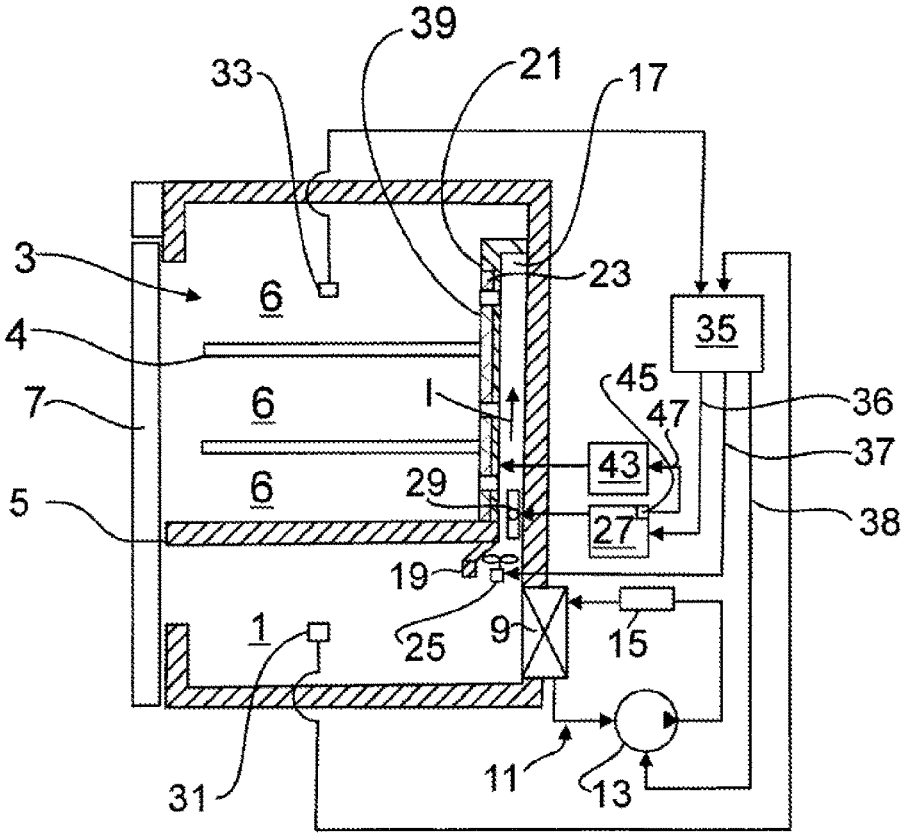
FIG. 3 shows a refrigerator according to the second exemplary embodiment viewed according to FIG. 1.

FIG. 3 shows a refrigerator according to the second exemplary embodiment, which is largely identical to the first exemplary embodiment in terms of construction and function. Reference is made in this respect to the description of the first exemplary embodiment.

Unlike in the first exemplary embodiment the defrost heating element 39 is not connected to the control device 35 via the signal cable 41. The defrost heating element 39 therefore does not have the cooling signal $S_k$ applied to it directly by the control device 35. Instead, according to FIG. 3 an opening sensor 45 is provided in the flap actuator 27. The opening sensor 45 activates the defrost heating element 39 via the signal cable 47 in response to a recorded flap opening signal, whereby the control device 35 is released by means of a signal, in comparison to the first exemplary embodiment. The timing element 43, which likewise only activates the defrost heating element 39 with a time delay after expiry of the time interval $\Delta t_V$, is connected in the signal cable 47.

LIST OF REFERENCE CHARACTERS

1 Freezer chamber
3 Cooling chamber
4 Horizontal shelves
5 Horizontal partition
6 Refrigerator compartments
7 Appliance door
9 Evaporator
11 Refrigerant circuit
13 Compressor
15 Expansion element
17 Cold air channel
19 Air inlet
21 Cold air channel cover panel
23 Air outlets
25 Fan
27 Actuator
29 Valve element
31, 33 Chamber sensors
35 Control device
36, 37, 38, 41 Signal cables
43 Timing element
45 Opening sensor
47 Signal cable
$S_K$ Cooling signal
$\Delta t_V$ Time interval

The invention claimed is:

1. A refrigerator, comprising:

a utility chamber for cooled goods;

a cold air channel to direct a cold air flow into the utility chamber, the cold air channel being separated from the utility chamber by a channel wall;

a control device configured to generate a cooling signal which is received by a cooling device to cause introduction of the cold air flow into the utility chamber as long as the cooling signal is being received by the cooling device;

a defrost heating element rendered operative by the cooling signal generated by the control device to prevent formation of condensate and/or ice when the cold air flow is fed into the utility chamber, the defrost heating element being disposed on the channel wall to prevent formation of condensate and/or ice on at least the channel wall; and a timing element configured to receive the cooling signal and, after a predetermined time interval, forward the cooling signal to the defrost heating element to delay operation of the defrost heating element in response to generation of the cooling signal.

2. The refrigerator of claim 1, constructed in the form of a domestic refrigerator.

3. The refrigerator of claim 1, wherein the defrost heating element is activated after expiry of the time interval when the cooling signal is present.

4. The refrigerator of claim 1, wherein the defrost heating element is configured to remain out of operation after expiry of the time interval and in the absence of the cooling signal.

5. The refrigerator of claim 1, wherein the time interval ranges between 2 and 6 minutes.

6. The refrigerator of claim 1, wherein the defrost heating element is supplied with varying levels of power depending on an ambient temperature.

7. The refrigerator of claim 1, wherein the defrost heating element is supplied at a first ambient temperature with power that is less than a power supplied at a second ambient temperature which is higher than the first ambient temperature.

8. The refrigerator of claim 1, further comprising a door for access to the utility chamber, said defrost heating element being operated for different lengths of time depending on a number of door openings within a given time.

9. The refrigerator of claim 8, wherein the defrost heating element is configured to operate for longer periods of time as the number of door openings increases.

10. The refrigerator of claim 1, wherein the defrost heating element is configured to operate for longer periods of time as the ambient temperature of the refrigerator increases.

11. The refrigerator of claim 1, further comprising a valve element arranged in the cold air channel and constructed to open the cold air channel when the cooling signal is present.

12. The refrigerator of claim 11, further comprising an opening sensor operably connected to the valve element and having a signal connection to the defrost heating element for activating the heating element in response to an opening of the valve element.

13. The refrigerator of claim 12, wherein the valve element is a flap.

14. The refrigerator of claim 1, wherein the defrost heating element has a planar arrangement on the channel wall.

15. A method for controlling a temperature in a utility chamber of a refrigerator, said method comprising the steps of:

generating a cooling signal which is received by a cooling device;

feeding a cold air flow to a utility chamber of a refrigerator, via a cold air channel, as long as the cooling signal is being received by the cooling device;

activating a defrost heating element upon receipt of the cooling signal to prevent formation of condensate and/or ice when the cold air flow is fed into the utility chamber providing a timing element to receive the cooling signal and subsequently forward the cooling signal to the defrost heating element; and delaying operation of the defrost heating element for a predefined time interval after generation of the cooling signal due to a time delay between a time at which the timing element receives the cooling signal and a time at which the timing element forwards the cooling signal to the defrost heating element, wherein the cold air channel is separated from the utility chamber by a channel wall, and wherein the defrost heating element is disposed on the channel wall to prevent formation of condensate and/or ice on at least the channel wall.

16. The method of claim 15, wherein the defrost heating element is activated after expiry of the time interval when the cooling signal is present.

17. The method of claim 15, wherein the defrost heating element is configured to remain out of operation after expiry of the time interval and in the absence of the cooling signal.

18. The method of claim 15, wherein the defrost heating element is supplied with varying levels of power depending on an ambient temperature.

19. The method of claim 15, further comprising a door for access to the utility chamber, said defrost heating element being operated for different lengths of time depending on a number of door openings within a given time.

20. The method of claim 15, wherein the defrost heating element has a planar arrangement on the channel wall.

* * * * *